United States Patent [19]

Frei et al.

[11] Patent Number: 4,684,276

[45] Date of Patent: Aug. 4, 1987

[54] INDIVIDUAL SHEET FEEDER DEVICE FOR PRINTER

[75] Inventors: Urs Frei, Bachenbülach; Harald Richter, Zürich; Donald Stait, Steinmaur, all of Switzerland

[73] Assignee: Contraves AG, Zürich, Switzerland

[21] Appl. No.: 780,529

[22] Filed: Sep. 26, 1985

[30] Foreign Application Priority Data

Sep. 28, 1984 [CH] Switzerland ..... 4663/84

[51] Int. Cl.[4] ..... B41J 13/26

[52] U.S. Cl. ..... 400/630; 400/583.3; 400/642; 400/709.2; 271/227

[58] Field of Search ..... 400/583.3, 630, 706, 400/708, 708.1, 709, 582, 624, 625, 642, 645.2, 703, 707.1, 709.2, 711; 271/110, 111, 265, 227

[56] References Cited

U.S. PATENT DOCUMENTS

| | | | |
|---|---|---|---|
| 2,111,116 | 3/1938 | Holzapfel | 400/581 |
| 3,684,076 | 8/1972 | Crain et al. | 400/708 |
| 4,268,021 | 5/1981 | Rutishauser et al. | 400/708 |
| 4,302,116 | 11/1981 | May et al. | 400/624 |
| 4,326,815 | 4/1982 | Kapp | 400/625 |
| 4,331,328 | 5/1982 | Fasig | 271/111 |
| 4,348,118 | 9/1982 | Skafvenstedt et al. | 400/708 |
| 4,531,851 | 7/1985 | Kondo et al. | 400/708 |
| 4,565,462 | 1/1986 | Yamamoto et al. | 400/708 |

FOREIGN PATENT DOCUMENTS

| | | | |
|---|---|---|---|
| 2648871 | 8/1978 | Fed. Rep. of Germany | 400/583.3 |
| 1488675 | 6/1967 | France . | |
| 2403887 | 4/1979 | France . | |
| 2441568 | 7/1980 | France | 400/708 |
| 294707 | 11/1953 | Switzerland | 400/708 |

*Primary Examiner*—Charles A. Pearson
*Assistant Examiner*—David A. Wiecking
*Attorney, Agent, or Firm*—Werner W. Kleeman

[57] ABSTRACT

A printer device for the individual feed of pre-printed sheets or tickets through a sheet guide channel to a printer platen of an associated printer comprises at least two sensors. The at least two sensors are connected to the inputs of a control processor which processes the electrical states of the sensors. The outputs LINE FEED and SELECT of this control processor are conducted to inputs of the SELECT and LINE FEED function input circuits of the associated printer. Commercially available printers can be converted into specialized printers for data recording or for filling in preprinted forms without substantial modification by employing this device.

3 Claims, 9 Drawing Figures

INDIVIDUAL SHEET FEEDER DEVICE FOR PRINTER

BACKGROUND OF THE INVENTION

The present invention broadly relates to sheet feeders for printers and, more specifically, pertains to a new and improved construction of an individual sheet feeder device for pre-printed forms or data recording sheets.

Generally speaking, the sheet feeder devices of the present invention is intended to be employed in conjunction with a conventional printer for individually feeding pre-printed forms, data recording sheets, tickets or the like to a print platen or print roller of the conventional printer and comprises at least one pre-printed form guide means for guide channel leading to the printer platen and at least one position sensor arranged in the region of the pre-printed form guide means.

In other words, the sheet feeder device or sheet feeder accessory device of the present invention for a conventional printer comprises a sheet feed guide structure or channel for guiding a manually-inserted sheet or pre-printed form to be printed into the printer.

The invention also pertains to the employment of the inventive sheet feeder device in conjunction with a conventional printer as a data-recording printer.

Measuring instruments are becoming increasingly computer-controlled or microprocessor-controlled in the course of general technological progress. Consequently, the need for recording measurement results is increasing, on the one hand, while the demands upon the quality of such recording as well as upon the quantity of data to be recorded are rapidly increasing, on the other hand.

Form printers or so-called ticket printers, i.e. printers for filling in print fields of pre-printed forms, are widely employed as data recording printers, e.g. in clinical analysis. Such printers are specially designed printers often intended for only one specific application and are usually designed around the particular form or ticket to be printed. At least the dimensions of the paper guide mechanism, the printer platen or roll and often also the external dimensions of the entire printer are based upon the particular form or ticket employed. Any modification of the format of the form or ticket in the course of further development also requires intrusive modifications to the data recording printer itself, up to and including complete redesign. Such format modifications of a form or ticket become necessary when more comprehensive supplementary data is to be printed out or when the decision is taken to broaden the functionality of the associated measuring instrument.

It is increasingly demanded in the course of this general technological development that data recording printers also be capable of doing graphics, i.e. that digitally transmitted measurement results be printed out in the form of graphical representations.

Matrix printers have been successful as the majority of data recording printers, since they fulfill the manifold demands at justifiable expense. So-called pretty printers, i.e. letter quality printers, near letter quality printers, correspondence printers or printers employing type elements, which are usually of more complicated design than matrix printers, are also occasionally employed as data recording printers. Such printers can provide hard copy output of the recorded data in typewriter quality or nearly so.

On the other hand, the same types of printer are widely employed as universal printers both in administrative and technological fields. The control of such generally employable matrix and type-element printers is usually effected by control characters which are, in part, received through the data channels conjointly with the data to be printed out (software control) and, in part, over separate control channels or lines (hardware control). Individual control commands, such as the START command or the PRINT/STOP command, can usually also be manually input with special function keys. Paper infeed can generally also be performed manually by employing function keys provided for this purpose. Externally controlled devices for automatic paper feed are also commonly employed.

The line feed command or control character LF and the select switch command or control character SEL are particularly important commands for functional control of a printer. The line feed command or function LF advances or increments the paper by a predeterminate amount (a so-called print line) and, after termination of printing, ejects the paper or carrier of printed data. The select command or function SEL opens or closes one or more data channels from the source of data to the printer.

SUMMARY OF THE INVENTION

Therefore, with the foregoing in mind, it is a primary object of the present invention to provide a new and improved construction of an individual sheet feeder device which does not exhibit the aforementioned drawbacks and shortcomings of the prior art constructions.

A further significant object of the present invention aims at providing a new and improved construction of a data recording printer which, when operating as a form or ticket printer, is able to not only effect automatic form feed but also to take into account particular form formats, which requires exact adjustment of the pre-printed form.

A further significant object of the present invention aims at providing a new and improved construction of a data recording printer which retains its original function as a universal printer.

A further significant object of the present invention aims at providing a new and improved construction of an individual sheet feeder device or accessory device which permits the conversion of a universal printer into a data recording printer, a printer for pre-printed forms or a ticket printer with as little modification to the universal printer as possible.

A further significant object of the present invention aims at providing a new and improved construction of an individual sheet feeder device which provides positioncontrolled automatic form feed for a universal printer, thus allowing the universal printer to operate as a printer for data records, pre-printed forms or tickets.

A further significant object of the present invention aims at providing a new and improved construction of an individual sheet feeder device which permits the interpretation of index or registration marks on pre-printed forms and a corresponding exact adjustment of such pre-printed forms in relation to the print head of a printer.

Yet a further significant object of the present invention aims at providing a new and improved construction of an individual sheet feeder device of the character described which is relatively simple in construction and design, extremely economical to manufacture, highly reliable in operation, not readily subject to breakdown or malfunction and requires a minimum of maintenance and servicing.

Now in order to implement these and still further objects of the invention, which will become more readily apparent as the description proceeds, the individual sheet feeder device of the present invention is manifested by the features that the at least one position sensor responds to position-indicating features of the pre-printed form, ticket or the like, the at least one position sensor has predetermined electrical states, a control processor is provided for processing these predetermined electrical states, the control processor having input terminals and output terminals, the at least one position sensor being connected to the input terminals of the control processor, the printer having control input terminals and the output terminals being conducted to the control input terminals.

In other words, the present invention is manifested by the features that it comprises mounting means for removeably attaching the sheet feed guide structure to the conventional printer. It also comprises at least one sensing means for selectively performing a detection of at least a desired one of the following features including: a leading edge of the sheet or pre-printed form to be printed; a trailing edge of the sheet or pre-printed form to be printed; and at least one registration mark contained within the sheet or pre-printed form to be printed. The at least one sensing means is operatively associated with the sheet feed guide structure and comprises means for generating at least one detection signal in response to the detection of the at least one desired feature. A control processor is operatively connected to the at least one sensing means for receiving the at least one detection signal and comprises means for performing an evaluation of the received at least one detection signal in relation to at least one predeterminate print field of the sheet or pre-printed form to be printed. The control processor also comprises means for generating at least one LINE FEED control signal for transmission to the conventional printer for causing the conventional printer to automatically advance the sheet or pre-printed form to be printed by a predeterminate line spacing and means for generating at least one DEVICE SELECT control signal for transmission to the conventional printer for causing the conventional printer to accept external data for printing.

The present invention has the decisive advantage that, by a single modification, universal printers already on hand or required for other purposes can be employed as data recording printers for pre-printed forms, sales slips or tickets such as airline tickets. This modification is not grave and can be undertaken without internal modifications to the printer or its control means. The modification is preferably exclusively performed on components or connections of the printer which are accessible from the exterior anyway. The modification is therefore not limited to a certain category of printer or to a certain make of printer. On the contrary, practically all matrix printers, letter printers or ink jet printers available on the market can be adapted in the manner provided by the present invention. The modification is also independent of the type of printer interface, i.e. independent of whether a parallel or a serial interface is employed between the printer and the source of data.

A printer modified in this manner can be employed as a full-fledged ticket printer or data recording printer, e.g. for clinical analysis. It is able to provide the response to predetermined control, index or registration marks which is required by the form to be printed. These marks are applied to the ticket or form, e.g. in the form of visible marks, and preferably indicate the exact positioning of the ticket or form in the vertical direction in relation to the print head of a conventional printer and, in appropriate cases, also in horizontal direction. In this manner an outstanding print quality can be achieved without the arisal of misregistration in relation to pre-printed fields of the form. Such misregistration is not only unattractive but, for instance when working with medical technology or data, can lead to dire consequences and must therefore be avoided at all costs.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

As already initially mentioned, the individual sheet feeder device to be described in more detail in the following exploits the general control possibilities of commercially available matrix printers, pretty printers and ink jet printers and especially exploits the possibility of controlling such printers through separately accessible control functions, such as the select command SEL or the line feed command LF. These control functions may be separately accessible through their connections to operating keys or to control signal connections or terminals.

The activation by the sheet feeder device of these control functions is incorporated into a supplementary logic control processor regulated by means of sensors, e.g. optical sensors, which respond to appropriate markings or analogous features on pre-printed forms to be processed. Form feed and positioning is thus not only automatically performed but is also individually and variably controlled by each pre-printed form in the processing or printer queue. The additionally provided control processor does not intervene in the electronics of the printer. The printer is practically controlled by the pre-printed form itself, preferably according to the following sequence: feed in form / advance form / initiate printing process / terminate printing process / eject form. The processing of the features or signals received from the form as well as the derivation of appropriately corresponding printer control signals are performed by the control processor to be described later.

An advantageous embodiment of the invention in which the control processor inhibits the printing process when the inserted pre-printed form or ticket is for any reason prematurely retracted from the paper guides increases user friendliness. The control processor takes into account the usual provision of a buffer register or memory in a printer. Several data records, corresponding to the data for several pre-printed forms, can be read into such a buffer register. After printing and ejecting a form, the control processor disables the SEL signal and therefore also the data channel in order that no data be printed on the bare printer platen or roll. The printer returns to the ready state and awaits the insertion of the next form before printing further data records.

Figure 1:
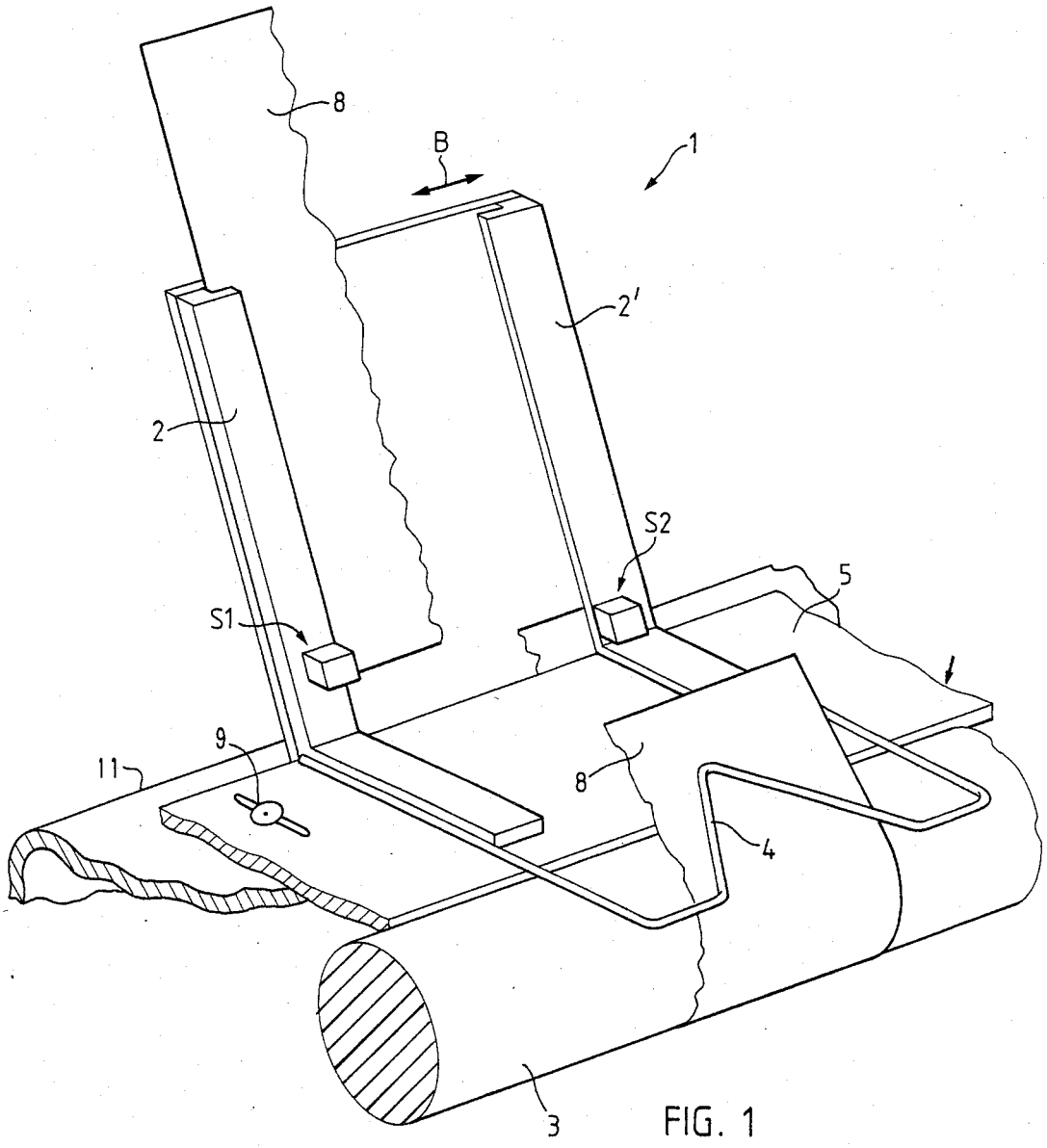
FIG. 1 schematically shows in perspective view the individual sheet feeder device of the invention and portions of a universal printer equipped with the device.

Describing now the drawings, it is to be understood that to simplify the showing thereof only enough of the structure of the individual sheet feeder device has been illustrated therein as is needed to enable one skilled in the art to readily understand the underlying principles and concepts of this invention. Turning now specifically to FIG. 1 of the drawings, the device or apparatus illustrated therein by way of example and not limitation will be seen to comprise a sheet feeder mechanism or guide structure 1 forming the mechanical portion of the sheet feeder device employed in conjunction with a commercially available printer. The sheet feeder mechanism 1 is fastened above the printer platen or roll 3 of the printer through the intermediary of a mounting panel or plate 5. Guide slots or channels 2 and 2' corresponding to the width of a sheet or pre-printed form 8 and optionally translatable transverse to the sheet transport direction in the direction of the double-headed arrow B are constructed as a feed slot or chute for the sheet or pre-printed form 8. An appropriately formed guide bail 4 holds the sheet or preprinted form 8 (guided around the printer platen 3 and only partially illustrated in FIG. 1) in the proper position for printing. For the sake of ready comprehensibility, the friction rollers and the print head of the printer are not illustrated in FIG. 1. In service, the print head is conducted over the sheet or pre-printed form 8 to be printed in the usual manner. The desired printing width is, for example, controlled by the application software.

Two sensors, e.g. two optical gates or detectors S1 and S2, are mounted at opposite sides of the sheet feeder mechanism 1 on the guide channels 2 and 2', respectively, in staggered or vertically different positions in relation to one another and in relation to the pre-printed form or sheet 8 to be fed into the printer. These sensors, i.e. the exemplary optical detectors S1 and S2, deliver the necessary information for the control processor to achieve or effect the desired sheet or pre-printed form positioning. As explained more fully hereinafter, these sensors may sense a leading edge, a trailing edge or an internal feature of the pre-printed form or sheet 8. Each sensor may sense a different such feature. For instance, one sensor may sense a leading edge or an internal feature of the pre-printed sheet or form 8, such as a mark or an aperture near the leading edge, for initially activating the printer platen or roll 3, while the other sensor senses the trailing edge or an analogous feature near the trailing edge for terminating control of the printer platen or roll 3 by the sheet feed or mechanism 1 and transferring control to the printer itself under software line feeds. This permits adjusting the sensor which is sensitive to the trailing edge for accommodating differing lengths of sheet or pre-printed form 8 independently of the other sensor. The mechanical arrangement for guiding the sheet or pre-printed form 8 can also be easily mounted on an existing printer with the aid of the mounting panel 5 and removed again.

The sheet or pre-printed form 8 drawn around the printer platen or roll 3 with the aid of the optical sensor control means is picked up by the guide bail 4 after leaving the paper guide means formed by the guide channels 2 and 2' of the printer and is brought into printing position. It is advantageous for the pre-positioned print head, which normally comprises its own paper guide plate, to be conjointly employed as a portion of the entire pre-printed form or sheet guide or guidance means. In certain types of printer the mechanical complexity is thereby considerably simplified.

Except for minor mechanically adaptive measures on a housing 11 of the printer, such as tapping threaded holes for screws 9 for mounting the described sheet feeder device or accessory, no further measures in relation to the mechanical equipment are necessary for connecting the conventional printer with the described sheet feeder device or accessory. The connection can, however, also be effected by any other releasable or permanent fastening means.

Figure 2:
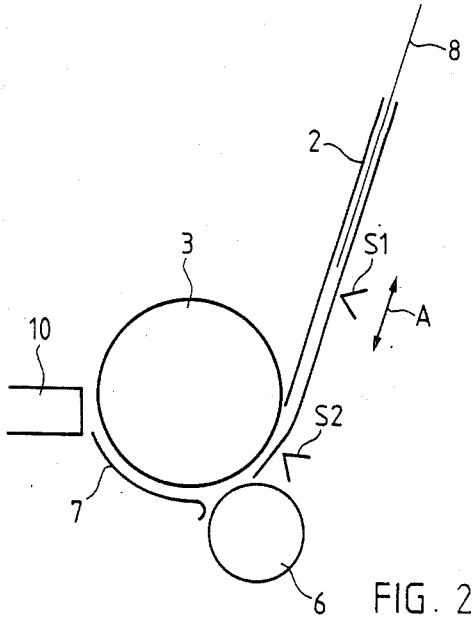
FIG. 2 schematically shows a pre-printed form in the upper region of the inventive sheet feeder device.
Figure 3:
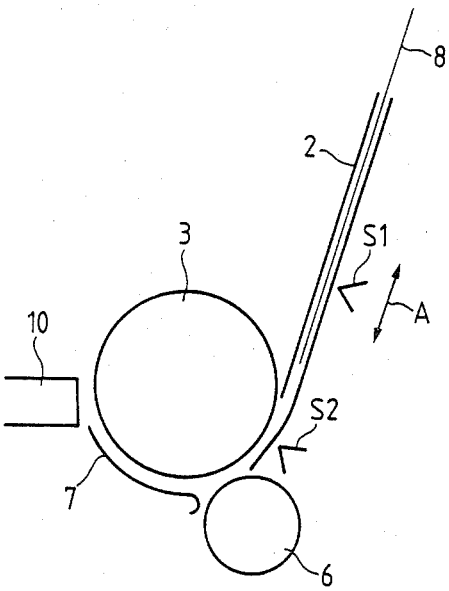
FIG. 3 schematically shows the pre-printed form in a middle region of the sheet feeder device of FIG. 2.
Figure 4:
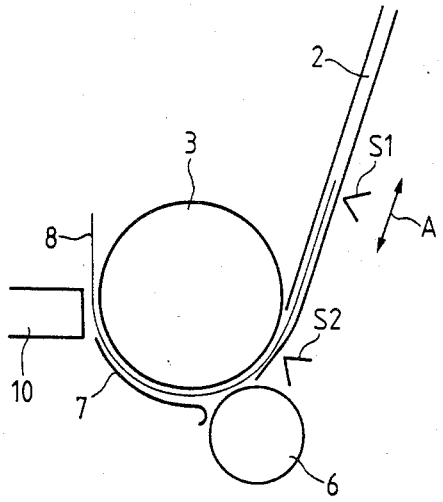
FIG. 4 schematically shows the pre-printed form in a lower region of the sheet feeder device of FIG. 2.

The function of the sensors, which in this illustrative embodiment are the optical gates or detectors S1 and S2, is shown schematically in FIGS. 2, 3 and 4. These figures quite generally show a guide channel 2 with the sheet or pre-printed form 8 inserted therein. The sheet or pre-printed form 8 is transported past the two optical gates or detectors S1 and S2 and between the printer platen or roll 3 and the friction wheel or roller 6 to the print head 10. A guide plate or baffle 7 constitutes the previously mentioned paper guide means of the printer. At least one of the optical gates or detectors S1 and S2, in this illustrative embodiment the upper optical gate or detector S1, is translatably adjustable in the direction of the arrow A for fine adjustment of the desired form a ticket position. This permits spacing the optical gates or detectors S1 and S2 apart by a predeterminate distance, for instance a distance equal to or otherwise related to the spacing of the first line to be printed from the leading edge of the pre-printed form 8.

This optical gate or detector arrangement offers in rough approximation the possibility of detecting four pre-printed form or sheet positions in each direction of feed motion:

1. S1 OFF / S2 OFF
2. S1 ON / S2 OFF
3. S1 ON / S2 ON
4. S1 OFF / S2 ON

A combination, i.e. a sequence, of several of the basic states listed above can arise if the sheet or pre-printed form 8 is translated past the optical gate or detector S1 but is then withdrawn from the paper guide means comprising the guide channels 2 and 2' before having reached the optical gate or detector S2. The conditions or states listed above are employed in this illustrative embodiment for controlling the associated printer in a manner to be described in more detail later by using the control processor.

In the following, the sequence of functions of the control processor and its cooperation with the printer will be described. FIG. 2 shows the position of the sheet or preprinted form 8 in which it is being transported, i.e. manually inserted, toward the optical gate or detector S1. Since both sensors S1 and S2 have not yet responded, condition "1", of the above list prevails, i.e. the state S1 OFF / S2 OFF. Under these conditions the printer is kept in the ready state. This means that the print head 10 is, for instance, situated in a position in which it simultaneously forms a portion of the pre-printed form or sheet guide means. The paper advance mechanism of the printer remains idle. Both the line feed control signal LF and the select control signal SEL are inactive.

In the position according to FIG. 3 the sheet or pre-printed form 8 has reached the optical gate or detector S1. The position 2, i.e. the state S1 ON / S2 OFF, is recognized from the electrical states of the two optical gates or detectors S1 and S2. The line feed control signal LF is activated in anticipation of ingesting a pre-printed form or sheet 8.

Figure 7:
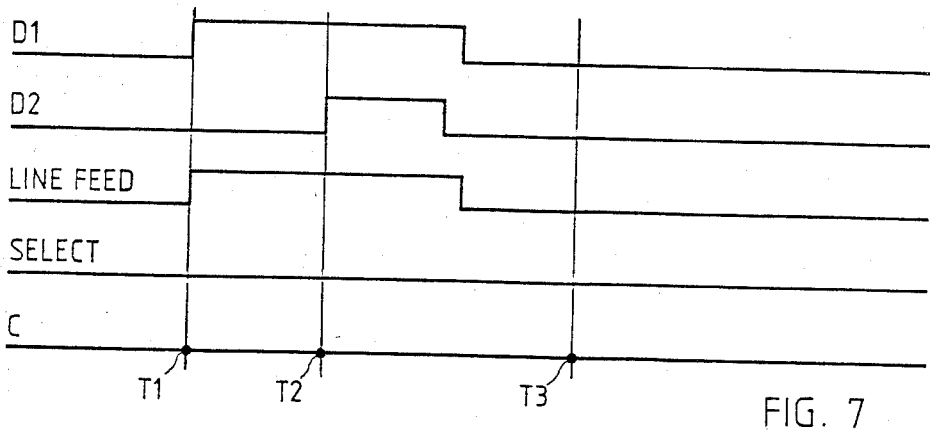
FIG. 7 schematically shows the signal timing diagram of the circuit of FIG. 5 under different conditions.

The individual sheet feeder device, i.e. its control processor, is now aware that a sheet or pre-printed form 8 has been inserted and is waiting to be either further inserted or withdrawn. If the sheet or pre-printed form 8 is withdrawn, the state S1 ON-OFF / S2 OFF i.e. the sequence of states 1 - 2 - 1, is induced which advantageously causes the printer to revert to the ready or wait state waiting for the valid insertion of a sheet or pre-printed form to be printed (after having briefly activated the paper advance mechanism in anticipation of a valid insertion as shown in FIG. 7).

Figure 6:
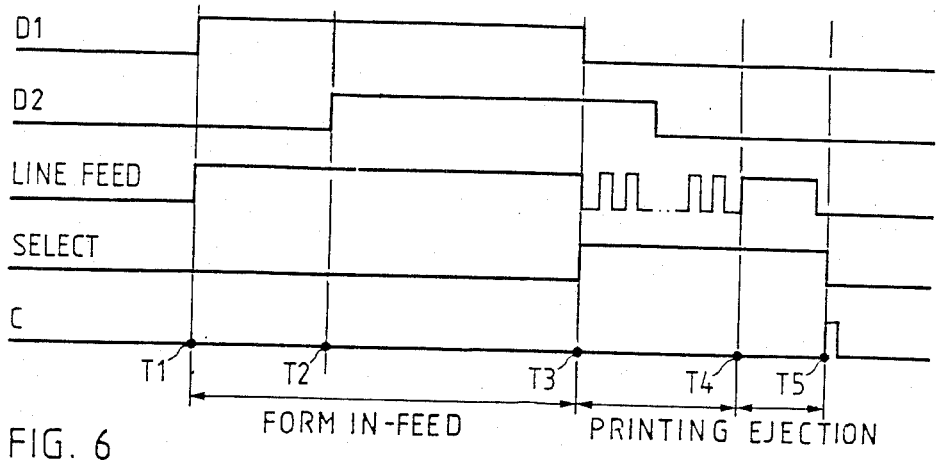
FIG. 6 schematically shows the signal timing diagram of the evaluation circuit of FIG. 5.

If the sheet or pre-printed form 8 is not withdrawn but further inserted, the position 3 according to FIG. 4, i.e. the state S1 ON / S2 ON, results and is, for instance, utilized to activate or enable the printer line feed control function LF and thereby maintain the printer platen or friction roller 3 in operation as shown in FIG. 6. The sheet or pre-printed form 8 is therefore now actively drawn in until it reaches the position 4, i.e. the state S1 OFF / S2 ON. This also means that the sheet or pre-printed form 8 has reached its desired printing position, whereupon the paper transport of the printer is stopped. The line feed control signal LF generated in response to the electrical states of the sensors S1 and S2 is deactivated. The printer select control function SEL is initiated by the same criterium, opening a data channel so that printing of the transmitted recorded data begins. Further transport of the pre-printed form or sheet 8 during printing is effected line-by-line in response to discrete line feed signals LF generated in response to a control signal SWLF under software control by the printing process (software line feed).

The desired printing position can be finely adjusted by translatably adjusting the optical gate or detector S1. For example, the lower or bottom, i.e. trailing, edge of the sheet or pre-printed form 8 initiates the printing process. The lower edge is therefore the reference value for the print field to be printed upon the sheet or pre-printed form 8. The lower edge forms, in this illustrative embodiment, a position or control feature to which the sensors S1 and S2 respond. According to a modified embodiment, other types of control features can be provided on the sheet or pre-printed form 8 instead of employing the lower edge of the pre-printed form or sheet 8 or in supplement thereto. Such other types of control features can, for instance, be optically or magnetically readable bars, punchings or analogous markings. Coded characters, for instance in the form of a bar code on the sheet or pre-printed form 8, preferably on its border or edge region, can also be applied. The sensors must be adapted to the particular type of marking or coding employed. The pre-printed form or sheet 8 to be printed will normally define a first line to be printed. This line will have a predetermined spacing relative to the control features, for instance to the lower or trailing edge of the pre-printed form or sheet.

For print fields of a pre-printed form or sheet which are to be printed under special conditions, but which are to remain unprinted in normal operation for any reason whatsoever, tickets can be employed having a perforation permitting a portion to be torn off before the special printout occurs, the now shorter ticket permitting a printing of the upper or header region.

Any kind of specially distinguished ticket having edge markings on the left and right sides or on only one side, with space-coded marks, registration or indexing holes, et cetera, can be employed in combination with optical gates or detectors. However, it is only shown here how widely variable this basically quite simple measure of the invention for realizing a very efficient data recording printer can be.

In the following an example of the control processor will be described in relation to FIG. 5. The control processor processes sensor signals D1 and D2 arriving from the sensors, i.e. the exemplary optical gates or detectors S1 and S2, respectively, and derives therefrom suitable control signals for the printer 50.

As already mentioned, the sheet feeder device exploits only two switching functions which are present on most printers, both matrix and letter quality or ink jet printers, i.e. line feed or paper transport in the vertical direction with software-controllable step lengths LF and select or data flow on/off SEL.

Figure 5:
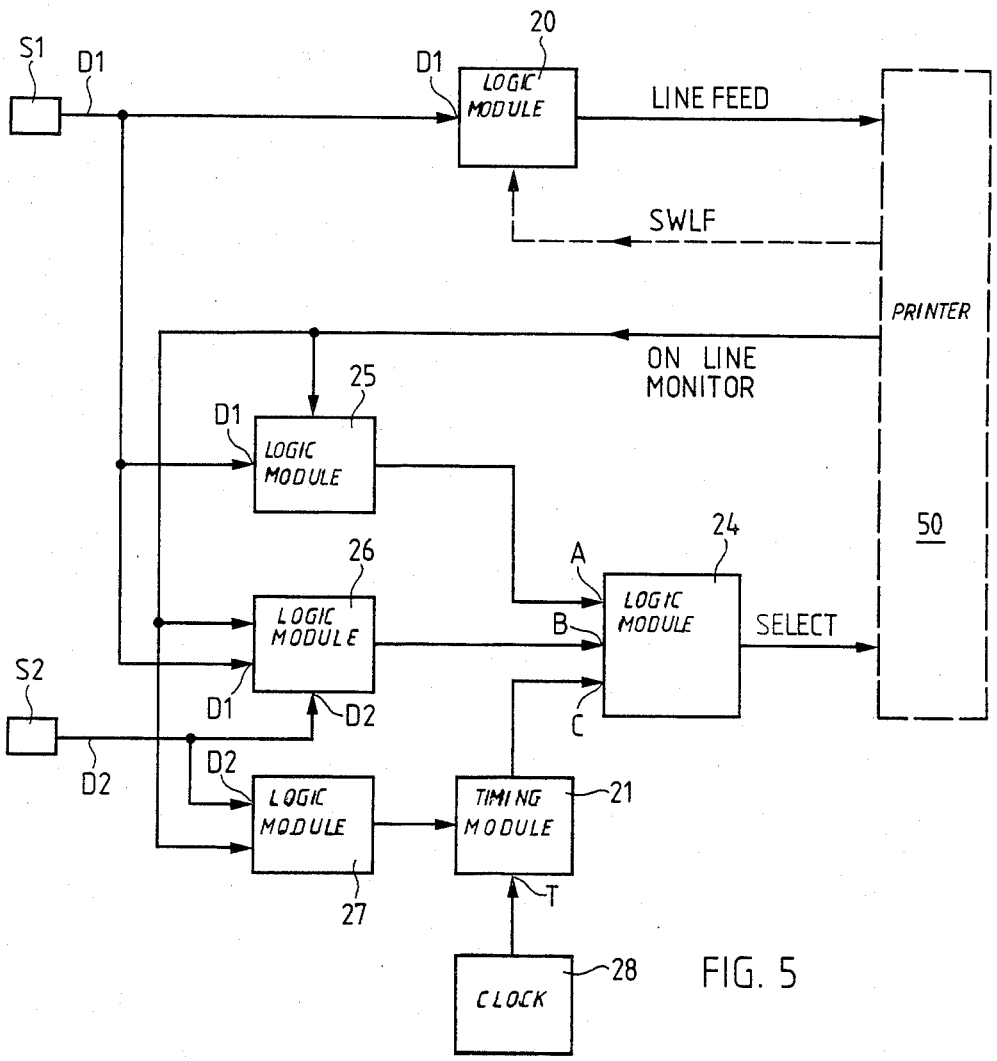
FIG. 5 schematically shows a circuit diagram of a first embodiment of an electronic evaluation circuit.

According to FIG. 5, the signal D1 of the first sensor S1 is, on the one hand, conducted to a first clocked or tach-controlled logic module 20 and, on the other hand, to a second and a third logic module 25 and 26, respectively. The signal D2 of the second sensor S2 is conducted to both the third logic module 26 and a fourth logic module 27. The second, third and fourth logic modules 25, 26 and 27, respectively, are furthermore supplied with a ready signal ON-LINE MONITOR coming from a data source associated with the printer 50. The output of the fourth logic module 27 is connected with a timing module 21 which is controlled by a tact or clock signal T of a tach or clock circuit 28. The timing module 20 can also be wired as a mono-flop or multi-vibrator. An output C of the timing module 21 leads to a fifth logic module 24. Outputs A and B of the second and third logic modules 25 and 26, respectively, are also conducted to the fifth logic module 24. The select signal SEL for controlling the associated printer 50 appears at an output of the fifth logic module 24. The first logic module 20 applies its output to an LF control input of the printer 50.

FIG. 6 shows the corresponding signals as they appear in normal operation of the circuit according to FIG. 5. The cycle begins at the time T1 when the sheet or preprinted form 8 reaches the first sensor S1 and sets the not particularly shown feed or advance motor of the printer 50 in operation through a conductor carrying the control signal LF. At time T1 the state of the sensors S1 and S2 changes from S1 OFF/S2 OFF to S1 ON/S2 OFF. Thereupon the sheet or pre-printed form 8 is transported beyond the time T2 at which the sheet or pre-printed form 8 reaches the second sensor S2. At time T2 the state of the sensors S1 and S2 changes from S1 ON/S2 OFF to S1 ON/S2 ON. At the time T3 the sheet or pre-printed form 8 has reached the desired printing position. At time T3 the state of the sensors S1 and S2 changes from S1 ON/S2 ON to S1 OFF/S2 ON. The select control line SEL for accepting printing data is now activated on enabled. The control signal LF is terminated. Corresponding to the now active software control, software-generated line feed signals SWLF now occur in connection with the printing program. After termination of the printing process at time T4 end of data, first an extended and also software-controlled line feed signal LF (SWLF) is given for initiating ejection of the sheet or pre-printed form 8. After termination of this transmission, a signal C appears at time T5 which again disables or inhibits the control input SEL.

FIG. 7 illustrates the case in which a sheet or pre-printed form 8 was initially inserted and had therefore passed the firt sensor S1, but was then withdrawn again. The signal D2 coming from the second sensor S2 is terminated before time T3, whereupon the signal LF is also interrupted prematurely, since the sheet or pre-printed form 8 need not be brought into the printing position. The SEL signal is not activated or enabled.

Figure 8:
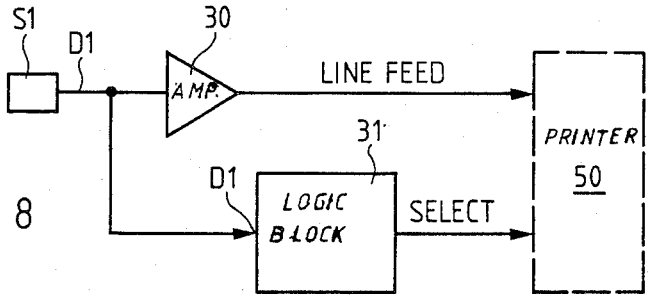
FIG. 8 schematically shows a simplified embodiment of an evaluation circuit.

A simplified embodiment having only one sensor S1 is represented in FIG. 8. The control processor in this case provides direct transmission of the signal D1 coming from the sensor S1 through an amplifier 30 to the control input LF of the printer 50. Simultaneously the control input SEL of the printer 50 is activated or enabled through a logic block 31. The logic block 31 blocks or inhibits the output (select) after expiration of a time determined in logic block 31 at T5 according to FIG. 9.

Figure 9:
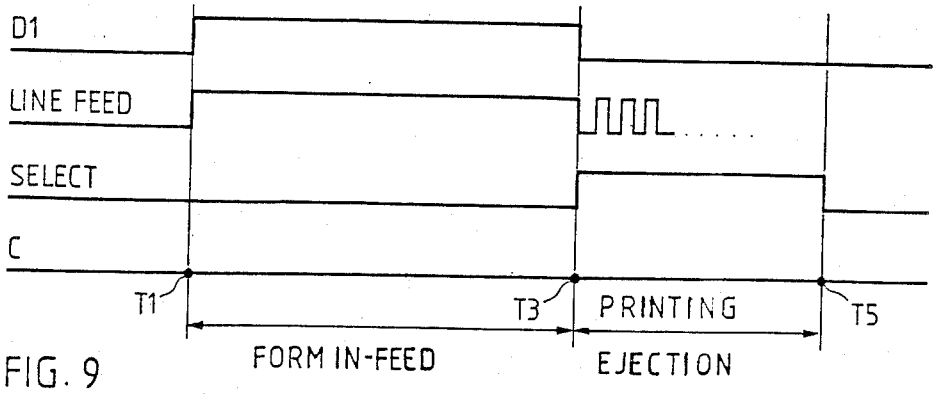
FIG. 9 schematically shows a signal timing diagram of the circuit of FIG. 8.

FIG. 9 shows the associated signal relationships. The sequence of functions substantially corresponds to that of FIG. 6.

A light-emitting diode, for instance ON-LINE, can optionally supplementarily be switched at the printer in order to indicate the general or a special state of operation, thus for instance if the data channel is opened or closed.

The illustrative embodiments given here are generally adapted to commercially available matrix printers. Other printers require other time window values which can be easily tried out. In principle, this type of circuit construction is suitable for all common printers.

Special tickets, sheets or pre-printed forms are not required for the described device. On the contrary, pre-printed forms or sheets already on hand and proven reliable can be employed without modification in an unmodified commercially available printer. The device described herein adapting such a printer and such sheets or pre-printed forms to one another permits an uncomplicated conversion of a commercially available universal printer into a high quality recorded data printer for processing sheets or pre-printed forms already in use.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A sheet feeder accessory device for feeding manually inserted pre-printed forms to a print point in a printer having a predetermined feed direction, comprising:

a sheet feed guide structure for guiding a manually-inserted pre-printed form to be printed into the printer;

mounting means for removably attaching said sheet feed guide structure to the printer;

sensing means comprising at least two optical position sensors arranged in said sheet feed guide structure in mutually differing spaced relationships prior to the print point in the printer in said predetermined feed direction for selectively performing a sequence of detection of at least a desired one of the features including:

a leading edge of the pre-printed form to be printed;

a trailing edge of the pre-printed form to be printed; and at least one registration mark contained within the pre-printed form to be printed;

said at least two optical position sensors comprising means for generating at least two detection signals in response to said sequence of detection of said at least one desired feature;

a control processor operatively connected to each of said at least two optical position sensors for receiving each said at least one detection signal;

said control processor comprising means for performing an evaluation of each received detection signal in relation to at least one predeterminate print field of the pre-printed form to be printed;

said control processor comprising means for generating in response to said performed evaluation at least one first control signal for transmission to the printer for causing the printer to automatically advance the pre-printed form to be printed by a predeterminate amount corresponding to a location of said at least one predeterminate print field; and said control processor comprising means for generating in response to said performed evaluation at least one second control signal for transmission to the printer for causing the printer to accept data for printing.

2. The device as defined in claim 1 wherein the optical position sensor closest to the print point senses the trailing edge of the pre-printed form to be printed or least one registration mark contained within the pre-printed form to be printed.

3. The device as defined in claim 1 wherein the optical position sensor furthest to the print point senses the leading edge of the pre-printed form to be printed or at least one registration mark contained within the pre-printed form to be printed.

* * * * *

UNITED STATES PATENT AND TRADEMARK OFFICE

CERTIFICATE OF CORRECTION

PATENT NO. : 4,684,276

DATED : August 4, 1987

INVENTOR(S) : Urs Frei et al

It is certified that error appears in the above-identified patent and that said Letters Patent is hereby corrected as shown below:

Column 3, line 24, after "a" insert --sequence of --.

Column 6, line 45, "a" should read -- or --

Column 7, line 37, "activate or enable" should read -- maintain --.

Column 9, line 9, "on" should read -- or --.

Column 9, line 21, "firt" should read -- first --.

Signed and Sealed this

Seventh Day of June, 1988

*Attest:*

*Attesting Officer*

DONALD J. QUIGG

*Commissioner of Patents and Trademarks*